US007925976B2

(12) United States Patent
Shin et al.

(10) Patent No.: US 7,925,976 B2
(45) Date of Patent: Apr. 12, 2011

(54) REFRIGERATOR HAVING USER AVATAR DISPLAY FUNCTION

(75) Inventors: Jong-Min Shin, Busan (KR); Sun-Cheol Bae, Masan-shi (KR); Su-Won Lee, Changwon-shi (KR); Jae-Seng Sim, Masan-shi (KR); Eun-Jeong Kim, Changwon-shi (KR); Eun-Young Park, Ulsan (KR); Deok-Hyun Youn, Ahnyang-shi (KR); Yong-Chol Kwon, Changwon-shi (KR); Byung-Koo Kong, Gimhae-shi (KR); Ku-Young Son, Busan (KR)

(73) Assignee: LG Electronics Inc., Seoul (KR)

( * ) Notice: Subject to any disclaimer, the term of this patent is extended or adjusted under 35 U.S.C. 154(b) by 332 days.

(21) Appl. No.: 11/359,434

(22) Filed: Feb. 23, 2006

(65) Prior Publication Data

US 2006/0256132 A1 Nov. 16, 2006

(30) Foreign Application Priority Data

May 13, 2005 (KR) ..... 10-2005-0040201

(51) Int. Cl.
*G06F 3/048* (2006.01)
*G06F 3/14* (2006.01)

(52) U.S. Cl. ..... 715/706; 715/864; 236/94; 62/37; 62/125; 345/619

(58) Field of Classification Search ..... 715/706, 715/864, 964; 345/619; 62/37, 125; 232/51, 232/94

See application file for complete search history.

(56) References Cited

U.S. PATENT DOCUMENTS

| | | | | |
|---|---|---|---|---|
| 5,796,640 | A * | 8/1998 | Sugarman et al. | 708/132 |
| 6,112,502 | A * | 9/2000 | Frederick et al. | 53/411 |
| 6,236,953 | B1 * | 5/2001 | Segal | 702/127 |
| 6,711,908 | B2 * | 3/2004 | Ferragut et al. | 62/129 |
| 6,715,302 | B2 * | 4/2004 | Ferragut, II | 62/129 |
| 6,889,510 | B2 * | 5/2005 | Song et al. | 62/132 |
| 6,927,871 | B1 * | 8/2005 | Silverbrook et al. | 358/1.15 |
| 7,090,141 | B2 * | 8/2006 | Roh et al. | 236/51 |
| 7,136,940 | B2 * | 11/2006 | Roh et al. | 710/8 |
| 7,262,810 | B2 * | 8/2007 | Roh et al. | 348/552 |
| 7,292,146 | B1 * | 11/2007 | Nguyen | 340/572.1 |
| 7,319,407 | B2 * | 1/2008 | Jang et al. | 340/691.1 |
| 7,508,378 | B2 * | 3/2009 | Tsukada | 345/169 |
| 2001/0010516 | A1 * | 8/2001 | Roh et al. | 345/169 |
| 2002/0004749 | A1 * | 1/2002 | Froseth et al. | 705/16 |
| 2002/0066279 | A1 * | 6/2002 | Kiyomatsu | 62/125 |

(Continued)

FOREIGN PATENT DOCUMENTS

JP 2003-399898 * 11/2003

(Continued)

*Primary Examiner* — Dennis-Doon Chow
*Assistant Examiner* — Linh K Pham
(74) *Attorney, Agent, or Firm* — KED & Associates, LLP

(57) ABSTRACT

A refrigerator is provided having a user avatar display function which can store avatars of each user, identify users, and display the avatars corresponding to the identified users. The refrigerator includes a photographing device that photographs images of users, a storing device that stores user information for identifying the users and avatar information having avatars corresponding to the users and/or user information, a display that displays the avatars, and a controller that reads the user information, compares the user information with the images of the users photographed by the photographing device, reads the avatar information according to the comparison result, and displays the avatars of the users included in the read avatar information on the display.

19 Claims, 6 Drawing Sheets

U.S. PATENT DOCUMENTS

2003/0046296 A1* 3/2003 Doss et al. ..... 707/102
2003/0175666 A1* 9/2003 Tanabe et al. ..... 434/236
2004/0035123 A1* 2/2004 Kim et al. ..... 62/127
2004/0117274 A1* 6/2004 Cenedese et al. ..... 705/28
2004/0196315 A1* 10/2004 Swearingen et al. ..... 345/804
2005/0060746 A1* 3/2005 Kim ..... 725/46
2005/0124388 A1* 6/2005 Seo et al. ..... 455/566
2005/0166154 A1* 7/2005 Wilson et al. ..... 715/751
2005/0234885 A1* 10/2005 Szeto et al. ..... 707/3
2005/0240494 A1* 10/2005 Cue et al. ..... 705/27
2005/0280544 A1* 12/2005 Mishelevich ..... 340/573.1
2006/0007357 A1* 1/2006 Lee ..... 348/552
2006/0174641 A1* 8/2006 Liu et al. ..... 62/246
2006/0192001 A1* 8/2006 Shaffer et al. ..... 235/385
2007/0044497 A1* 3/2007 Roo et al. ..... 62/264
2008/0195944 A1* 8/2008 Lee et al. ..... 715/706

FOREIGN PATENT DOCUMENTS

JP 2005164054 A * 6/2005
JP 2005-164054 A * 11/2008
KR 10-2004-0024243 3/2004

* cited by examiner

REFRIGERATOR HAVING USER AVATAR DISPLAY FUNCTION

TECHNICAL FIELD

The present invention relates to a refrigerator, and more particularly, to a refrigerator having a user avatar display function which can store avatars of each user, identify users, and display the avatars corresponding to the identified users.

BACKGROUND ART

A conventional refrigerator includes a display unit for providing information on the refrigerator and controlling the refrigerator, such as an LCD panel. A user interface is displayed on the display unit. The user interface displays a temperature inside a refrigerating chamber, a temperature inside a freezing chamber and a service state of a dispenser (water, flake ice, etc.) in the form of numbers, characters or icons. The display unit includes an input unit (for example, buttons) for controlling the temperature inside the refrigerator and the service of the dispenser.

FIG. 1 is a structure view illustrating a display unit of a conventional refrigerator. Referring to FIG. 1, the display unit displays a service type of a dispenser (cubic ice, flake ice), a set temperature of a freezing chamber and a set temperature of a refrigerating chamber, and has an input means at its lower portion.

The conventional refrigerator does not have a function of identifying users and providing data to the identified users.

DISCLOSURE OF THE INVENTION

The present invention is achieved to solve the above problems. An object of the present invention is to provide a refrigerator having a user avatar display function which can identify users and display avatars corresponding to the identified users.

Another object of the present invention is to provide a refrigerator having a user avatar display function which can identify users and transmit messages of another users to the identified users.

Yet another object of the present invention is to provide a refrigerator having a user avatar display function which can visually notify actions and states of users by changing avatars according to the actions and states of the users.

In order to achieve the above-described objects of the invention, there is provided a refrigerator having a user avatar display function, including: a photographing means for photographing images of users; a storing means for storing user information for identifying the users, and avatar information having avatars corresponding to the users and/or user information; a display means for displaying the avatars; and a control means for reading the user information, comparing the user information with the images of the users photographed by the photographing means, reading the avatar information according to the comparison result, and displaying the avatars of the users included in the read avatar information on the display means.

According to another aspect of the invention, there is provided a refrigerator having a user avatar display function, including: a storing means for storing avatar information having avatars corresponding to users; a display means for displaying the avatars; and a control means for changing the avatars according to user-related information and displaying the avatars on the display means.

BRIEF DESCRIPTION OF THE DRAWINGS

The present invention will become better understood with reference to the accompanying drawings which are given only by way of illustration and thus are not limitative of the present invention, wherein.

BEST MODE FOR CARRYING OUT THE INVENTION

A refrigerator having a user avatar display function in accordance with the present invention will now be described in detail with reference to the accompanying drawings.

Figure 1:
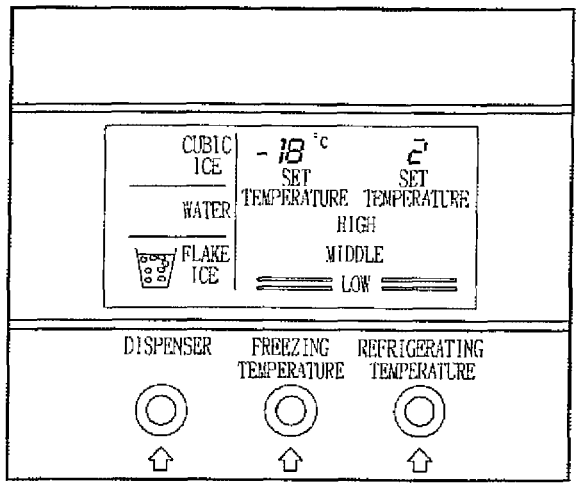
FIG.1 Prior Art
FIG. 1 is a structure view illustrating a display unit of a conventional refrigerator.
Figure 2:
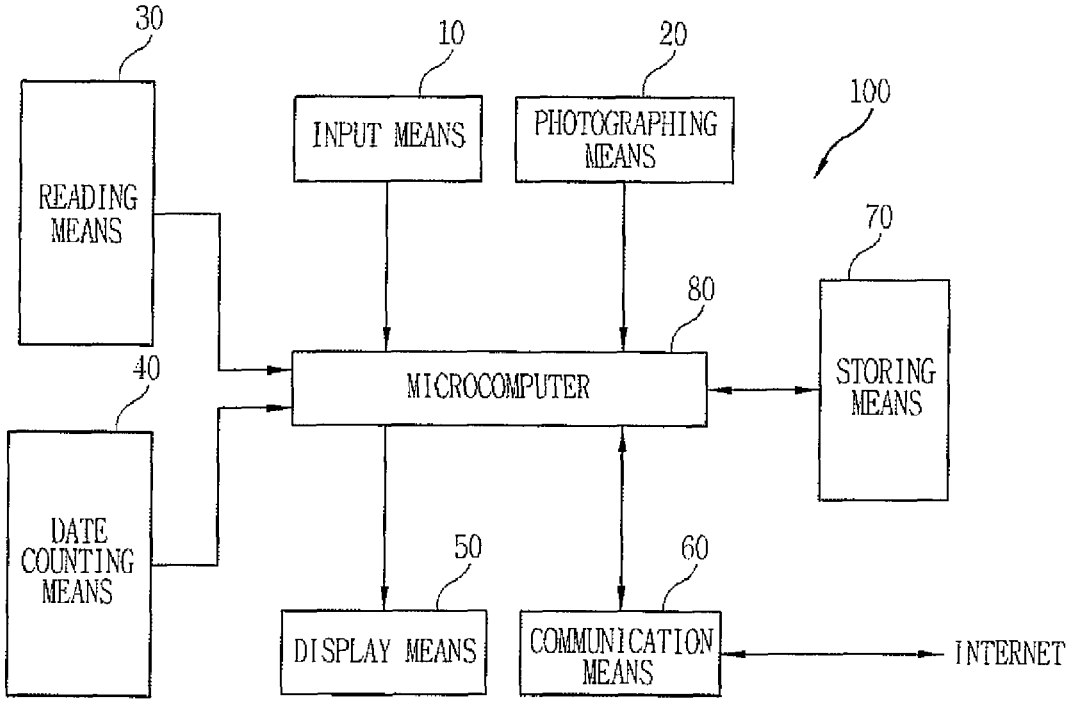
FIG. 2 is a block diagram illustrating a refrigerator having a user avatar display function in accordance with the present invention.

FIG. 2 is a block diagram illustrating the refrigerator having the user avatar display function in accordance with the present invention. As illustrated in FIG. 2, the refrigerator 100 includes an input means 10 for inputting a user command and/or data, a photographing means 20 for photographing images of users, a reading means 30 for reading an identifying means adhered to or printed on food and/or a food packing sheet, a date counting means 40 for counting a current date, a display means 50 for displaying avatars of the users, a communication means 60 for performing data communication with an external server (not shown) through an internet, a storing means 70 for storing at least user information for identifying the users and avatar information corresponding to the user information, and a microcomputer 80 for searching the identical user information by comparing the images of the users photographed by the photographing means 20 with the user information stored in the storing means 70, and displaying the avatars included in the avatar information corresponding to the searched user information on the display means 50, by controlling the aforementioned elements. The refrigerator 100 can further include a main microcomputer (not shown) for performing freezing and refrigerating control. The main microcomputer and the microcomputer 80 are connected through a communication line for data communication. Otherwise, the refrigerator 100 performs freezing and refrigerating control by the microcomputer 80. In addition, the refrigerator 100 includes a power supply means (not shown) for supplying power to each element.

In detail, the input means 10 allows the user to select the avatar for avatar formation, a photographing mode of the photographing means 20, and the user who is a message receiver and/or the corresponding avatar, and to input a text message. The microcomputer 80 reads avatar formation information (discussed later in detail) stored in the storing means 70, and displays the avatar formation information on the display means 50, so that the user can select the avatar from the displayed avatar formation information. When the user intends to obtain a user image or generate an image message, he/she can select the photographing mode of the photographing means 20. When the user intends to leave a message to another user, the user inputs the name of another user who is a message receiver or selects the corresponding avatar. Since the input means 10 has a keyboard structure, the user can input the text message by pressing characters. In addition, the input means 20 is used to select an avatar display service and an avatar change service by foods, input the user birthday, and select a biorhythm service. The input means 10 is related to the user interface displayed on the display means 50, and formed in a button or touch pad type.

The photographing means 20 photographs the images of the users. Here, the images of the users include iris images, fingerprint images or body shapes. The iris images and the fingerprint images are used for iris and fingerprint recognition. The photographing means 20 must have sufficient definition for the recognition. The body shapes include face shapes such as full-faces and profiles. In this case, the photographing means 20 can have a function of a general digital camera or digital camcorder. In order to perform the digital camcorder function, the photographing means 20 includes a mike for recording voice.

The reading means 30 includes an RF reading unit (not shown) for reading food information stored in an RFID displayed on or adhered to food, and/or a barcode reading unit (not shown) for reading food information of a barcode. Here, the food information includes at least a name (kind) and/or quantity of food. It is also possible to input the quantity of food by the input means 10.

The RF reading unit can be installed near the display means 50 (on the front surface of the refrigerator) for user's convenience or in the refrigerator. In the case that the RF reading unit is installed near the display means 50, when the user takes the food in or out, the RF reading unit reads the food information stored in the RFID on the food and/or the food package sheet. In addition, in the case that the RF reading unit is installed in the refrigerator, before/after the user takes the food in or out, the RF reading unit reads the RFID of the food. If the food information is read, the food is put in the refrigerator, and if the food information is not read, the food is taken out of the refrigerator. However, whether the food is taken in or out can be inputted by the input means 10.

The barcode reading unit for reading the barcode printed on the food, the food container or the food packing sheet is installed near the display means 50 for user's convenience. Reading the food information by the barcode reading unit is identical to the general method for reading the barcode. Here, whether the food is taken in or out can be inputted by the input means 10.

The input means 10 and the reading means 30 can be all mounted or selectively mounted.

The date counting means 40 counts and provides the current time periodically or upon the request of the microcomputer 80. The date counting means 40 is operated like a watch to display the current time on the display means 50.

The display means 50 includes a display device and/or a sound device for displaying the avatar formation information, the resultant avatars of the users, images and sounds of the messages, the text messages, the avatars changed from the original avatars of the users, and the biorhythms of the users.

The communication means 60 means a communication interface such as a wire/wireless modem for performing data communication between the microcomputer 80 of the refrigerator 100 and the external server (not shown) through the internet. The communication means 60 can be installed inside or outside the refrigerator 100.

Figure 3:
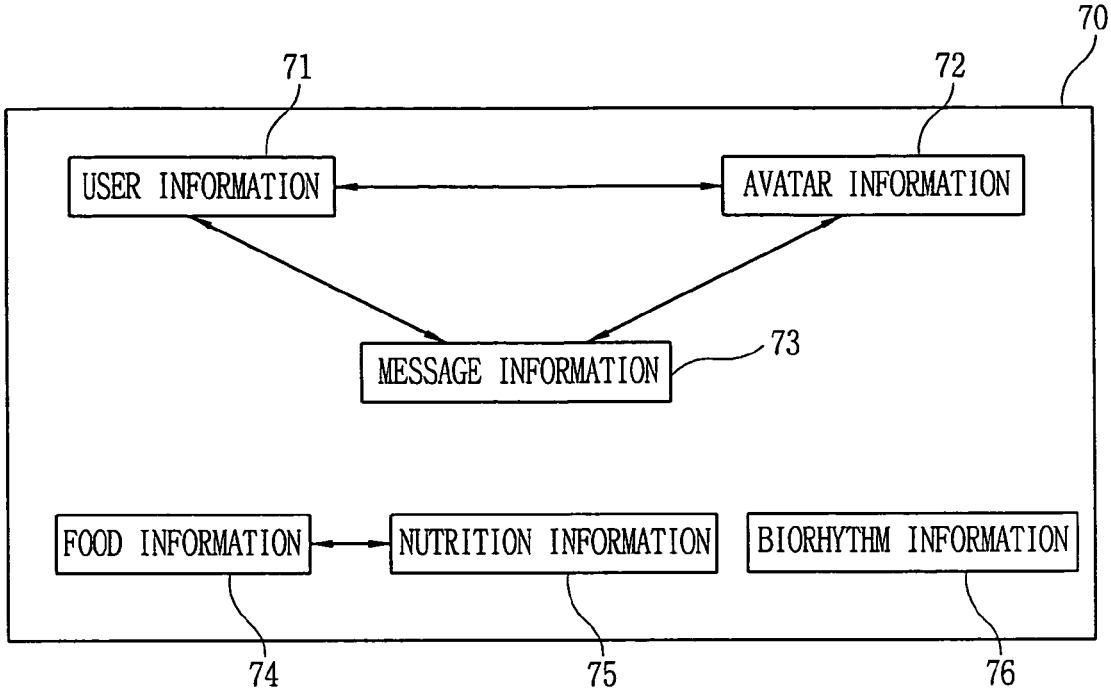
FIG. 3 is a block diagram illustrating a storing means of FIG. 2.

As shown in FIG. 3, the storing means 70 stores the user information, the avatar information and the message information that interwork with each other. Here, the user information for identifying the users includes the images, names and birthdays of the users, and the avatar information includes the avatar formation information which allows the user to select his/her avatar, the resultant avatar and/or the avatars of the whole users, and the avatars recognized in the same manner as the avatars of the users but changed in shape (for example, color, size, slim or fat, etc.). The avatar formation information may include the complete avatars or parts of the avatars (for example, face, body, arms, etc.). Therefore, the users can select the completed avatars, or form the avatars by selecting and combining parts of the avatars.

The message information includes image messages and sound messages obtained by the photographing means 20, and text messages inputted by the input means 10. The user information, the avatar information and the message information interwork with each other. Accordingly, when reading the user information, the microcomputer 80 accesses and reads the corresponding avatar and message information.

The storing means 70 stores food information including a kind and/or quantity of food included in the RFID or barcode of the food, and nutrition information on the nutrition contained in each food. Here, the storing means 70 can individually store the food information of each user. When the user eats the food, the microcomputer 80 reads the food information by the reading means 30, and continuously stores the read food information. The microcomputer 80 obtains the current date from the date counting means 40, and stores the current date with the food information, thereby storing the date when the user eats the food. Therefore, the food information and the nutrition information interwork with each other. When reading the food information of the user, the microcomputer 80 can calculate the quantity of food which the user has ingested for a predetermined period, and decide the nutrition by the ingestion quantity (for example, excess of protein, excess of fat, excess of heat value, etc.).

In addition, the storing means 70 stores biorhythm information for obtaining biorhythms of the users according to the birthdays included in the user information and the current date. The biorhythm information includes physical rhythm information, emotional rhythm information and intellectual rhythm information. The physical rhythm information indicates how the body can adjust to external physical changes, especially, immunity and functions of internal organs. The emotional rhythm information indicates emotions of human beings, especially, feelings or nervous systems controlling such feelings. The intellectual rhythm information indicates brain activity of human beings. Each of the rhythms has a certain period. The physical rhythm has a period of 23 days, the emotional rhythm has a period of 28 days, and intellectual rhythm has a period of 33 days.

The storing means 70 stores the user interface for inputting the message and selecting the user who is a message receiver and/or the corresponding avatar.

The microcomputer 80 generates the user information and forms the avatar by the user. The microcomputer 80 receives the user information from the input means 10, stores the user information in the storing means 70, selects the photographing mode by the input means 10, obtains the image of the user from the photographing means 20, and stores the image of the user in the user information. When the user selects avatar formation, the microcomputer 80 reads the avatar formation information stored in the storing means 70, and displays the avatar formation information on the display means 50. When the user selects the avatar by the input means 10, the microcomputer 80 adds the avatar to the avatar information as the avatar of the user. The microcomputer 80 further receives the avatar formation information from the external server through the communication means 60, stores the avatar formation information, and displays the avatar formation information on the display means 50, so that the user can use the information to form his/her avatar. The microcomputer 80 is ready to search the avatars by identifying the users according to the user information, by interworking the user information with the corresponding avatars or avatar information. The services provided by the microcomputer 80 will now be explained with reference to FIGS. 4 to 7.

Figure 4:
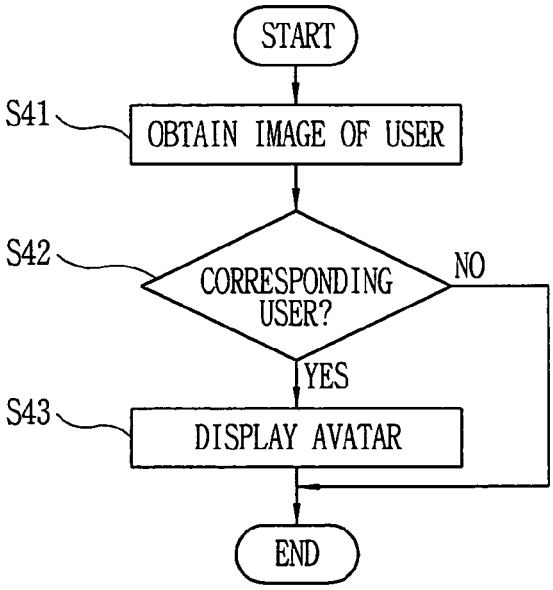
FIG. 4 is a flowchart showing a first example of the user avatar display function of the refrigerator in accordance with the present invention.

FIG. 4 is a flowchart showing a first example of the user avatar display function of the refrigerator in accordance with the present invention.

In detail, in S41, the microcomputer 80 receives selection of the photographing mode from the input means 10, and obtains the image of the user from the photographing means 20. Here, selection of the photographing mode can further include any one of selections of an iris recognition mode, a fingerprint recognition mode and a body shape recognition mode.

In S42, the microcomputer 80 reads the user information stored in the storing means 70, compares the user information with the image of the user, and decides whether the corresponding user and/or user information exists. If the corresponding user and/or user information exists, the routine goes to S43, and if not, the routine ends.

In S43, the microcomputer 80 reads the avatar information interworking with the user and/or user information, and displays the avatar included in the avatar information on the display means 50.

In the first example, the microcomputer 80 displays the previously-stored avatar corresponding to the image of the user on the display means 50.

Figure 5:
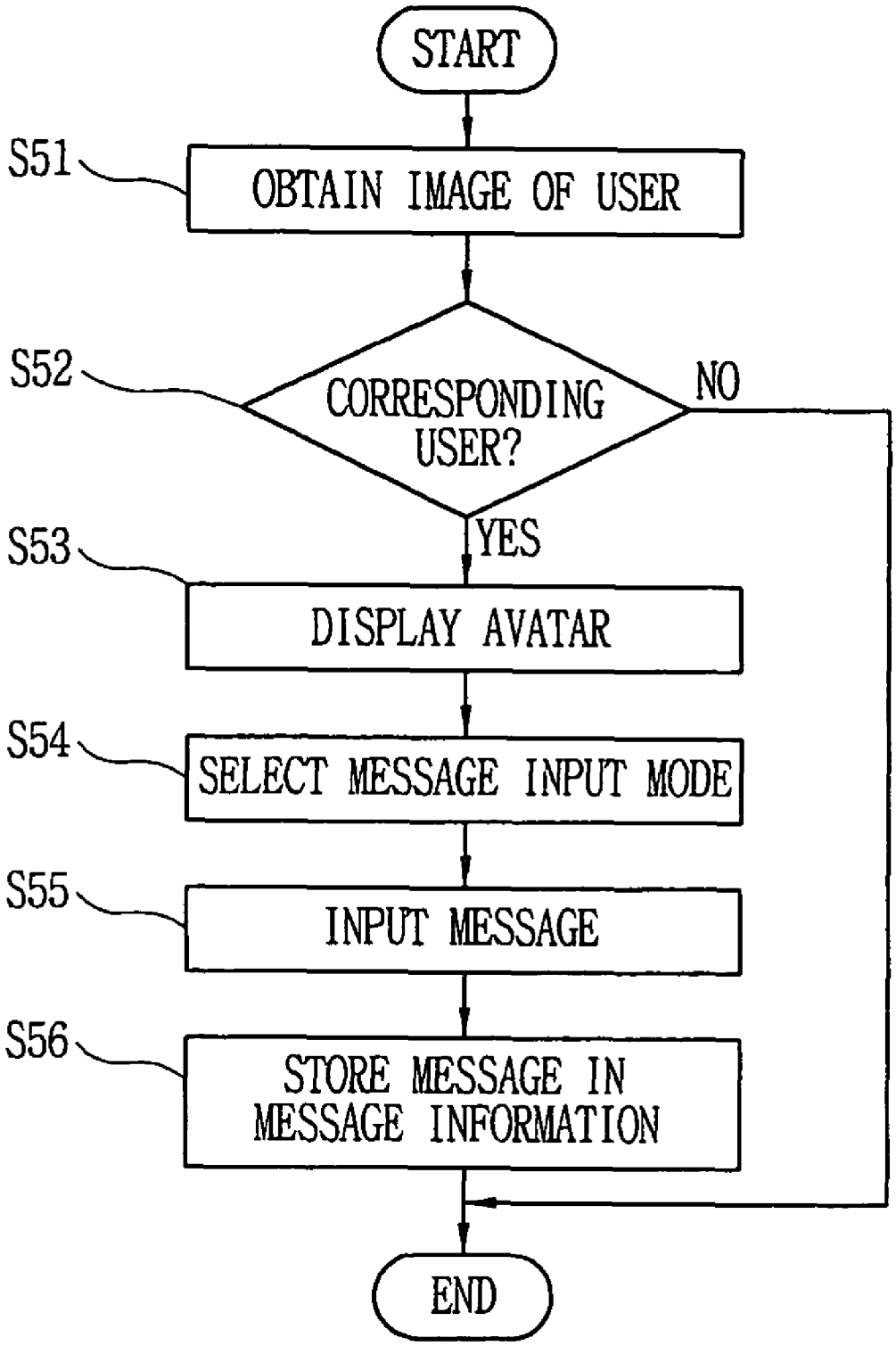
FIG. 5 is a flowchart showing a second example of the user avatar display function of the refrigerator in accordance with the present invention.

FIG. 5 is a flowchart showing a second example of the user avatar display function of the refrigerator in accordance with the present invention.

In detail, S51 to S53 are identical to S41 to S43 of FIG. 4.

In S54, the microcomputer 80 receives selection of the message input mode from the input means 10, reads the user interface from the storing means 70 for keyboard type input of the text message by the input means 10, displays the user interface on the display means 50, and prepares input of the image and sound messages of the photographing means 20.

In S55, the microcomputer 80 receives the message from the user. The message includes the text message from the input means 10 and the image and sound messages from the photographing means 20, and also includes the user (namely, another user) who is a receiver of the message selected by the user and/or the corresponding avatar.

In S56, the microcomputer 80 stores the message information including the message in the storing means 70, and also stores the user inputting the message and/or the corresponding avatar as a transmitter.

In the second example, the microcomputer 80 displays the previously-stored avatar corresponding to the image of the user on the display means 50, and inputs and stores the message for another user.

Figure 6:
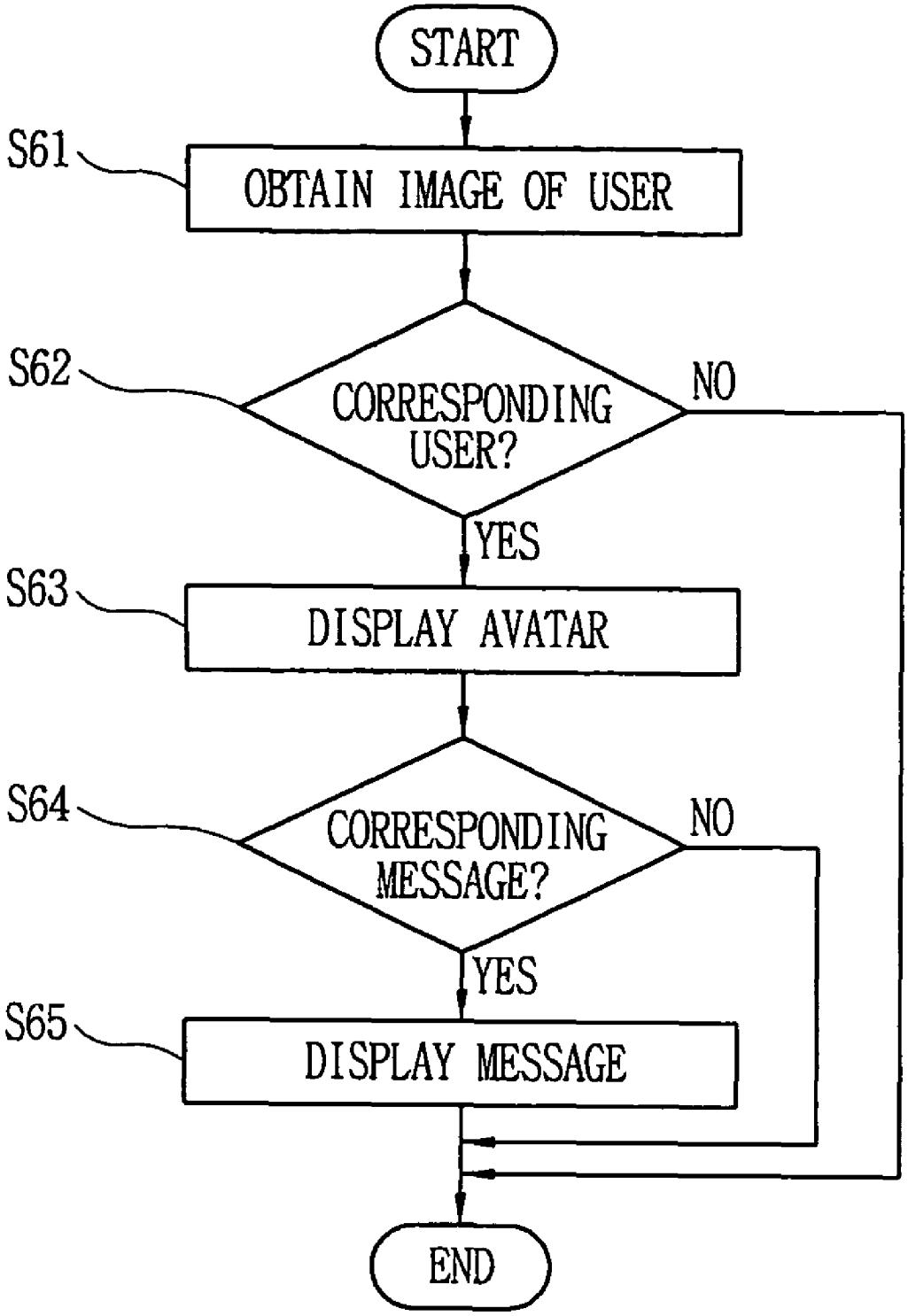
FIG. 6 is a flowchart showing a third example of the user avatar display function of the refrigerator in accordance with the present invention.

FIG. 6 is a flowchart showing a third example of the user avatar display function of the refrigerator in accordance with the present invention. The third example of FIG. 6 is related to the second example of FIG. 5.

In detail, S61 to S63 are identical to S41 to S43 of FIG. 4.

In S64, the microcomputer 80 decides whether the message information interworking with the user information and/or avatar information read in the previous step includes the message for the user. If so, the routine goes to S65, and if not, the routine ends.

In S65, the microcomputer 80 reads the message for the user, and displays the image, sound or text message on the display means 50. Here, the name of the user who is a transmitter or the corresponding avatar can be displayed.

In the third example, the microcomputer 80 displays the previously-stored avatar corresponding to the image of the user on the display means 50, and searches and displays the message for the user.

Figure 7:
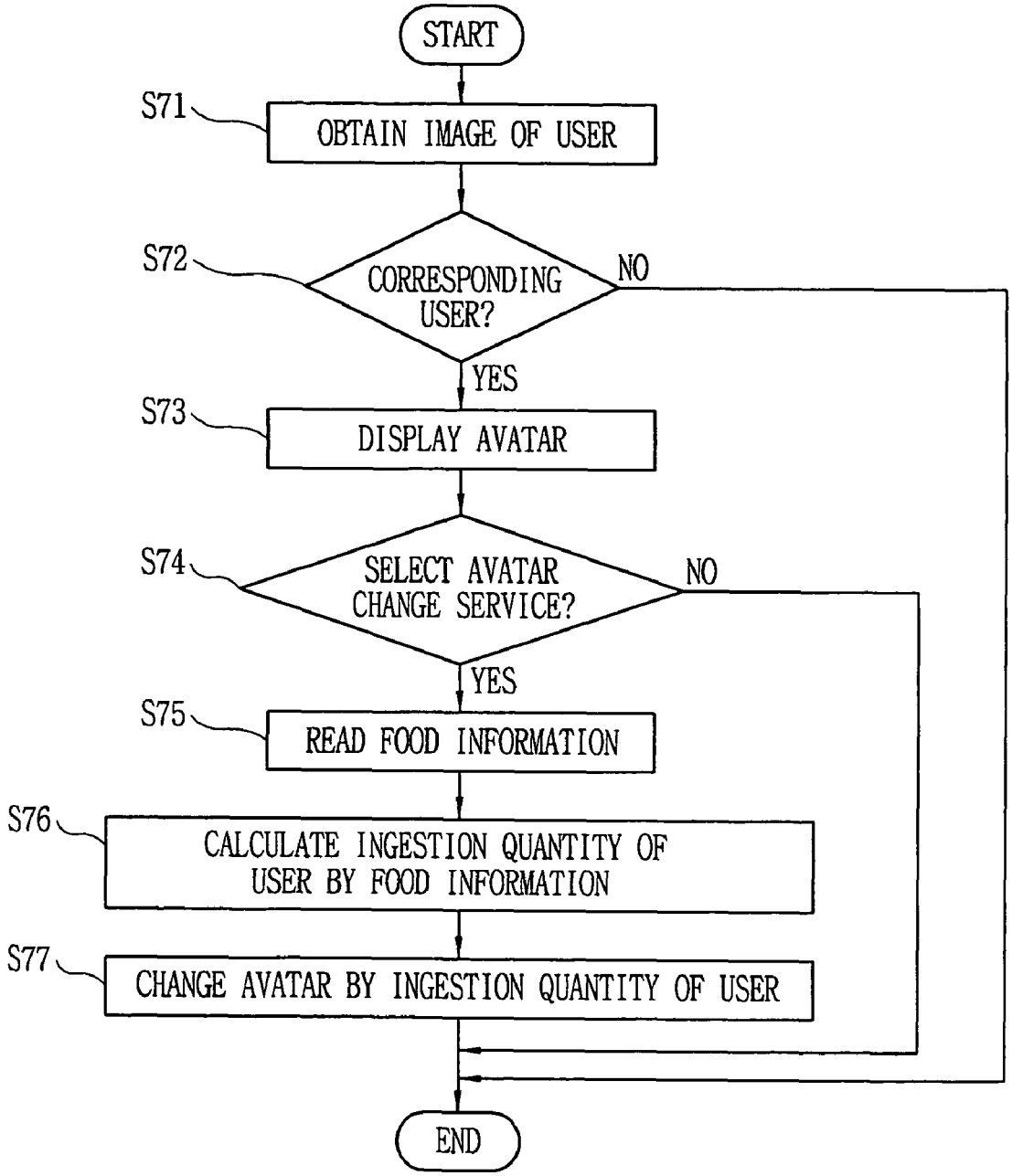
FIG. 7 is a flowchart showing a fourth example of the user avatar display function of the refrigerator in accordance with the present invention.

FIG. 7 is a flowchart showing a fourth example of the user avatar display function of the refrigerator in accordance with the present invention.

In detail, S71 to S73 are identical to S41 to S43 of FIG. 4.

In S74, the microcomputer 80 decides whether the user has selected the avatar change service on the previous or current food. If so, the routine goes to S75, and if not, the routine ends.

In S75, the microcomputer 80 reads the food information of the user corresponding to the user information and/or avatar information.

In S76, the microcomputer 80 reads the nutrition information interworking with the read food information, and calculates the quantity of food which the user has ingested for a predetermined period. The ingestion quantity includes the nutrition state of the user. For example, the ingestion quantity can be classified into lack, normal and excess.

In S77, the microcomputer 80 reads the changed avatar from the avatar information of the storing means 70 according to the calculated ingestion quantity of the user, and replaces the current avatar by the changed avatar, thereby visually displaying the ingestion quantity of the user.

In the fourth example, the microcomputer 80 displays the previously-stored avatar corresponding to the image of the user on the display means 50, and changes the avatar according to the ingestion quantity of the user to promote awareness.

Figure 8:
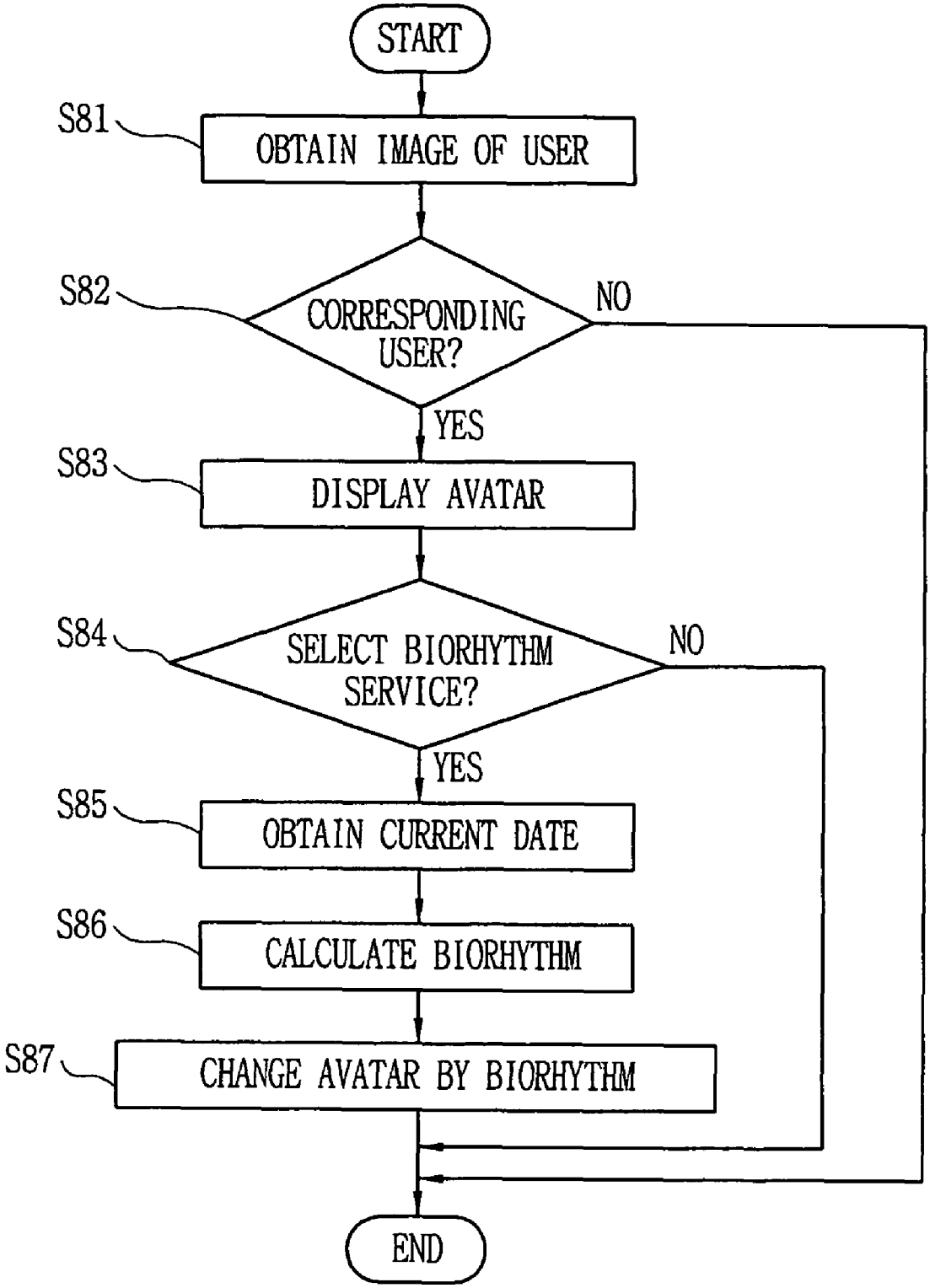
FIG. 8 is a flowchart showing a fifth example of the user avatar display function of the refrigerator in accordance with the present invention.

FIG. 8 is a flowchart showing a fifth example of the user avatar display function of the refrigerator in accordance with the present invention.

In detail, S81 to S83 are identical to S41 to S43 of FIG. 4.

In S84, the microcomputer 80 decides whether the user selected or selects the biorhythm service. If so, the routine goes to S85, and if not, the routine ends.

In S85, the microcomputer 80 receives the current date from the date counting means 40.

In S86, the microcomputer 80 obtains a biorhythm by operating the birthday of the user included in the previously-identified user information and the current date (at least the current year, month and day) according to the biorhythm information stored in the storing means 70.

In S87, the microcomputer 80 reads the changed avatar from the avatar information of the storing means 70 according to the biorhythm of the user, and replaces the current avatar by the changed avatar, thereby visually displaying the biorhythm of the user.

In the fifth example, the microcomputer 80 displays the previously-stored avatar corresponding to the image of the user on the display means 50, and changes the avatar according to the biorhythm of the user.

As discussed earlier, in accordance with the present invention, the refrigerator having the user avatar display function identifies the users, and displays the avatars corresponding to the identified users, so that the users can conveniently use the refrigerator.

In addition, the refrigerator having the user avatar display function identifies the users and displays the messages of another users to the identified users, thereby performing message transmission.

Furthermore, the refrigerator having the user avatar display function changes the avatars according to the ingestion quantity of the users, to promote awareness in eating habits of the users.

At last, the refrigerator having the user avatar display function changes the avatars according to the biorhythms showing the states of the users, thereby visually displaying the biorhythm information.

Although the preferred embodiments of the present invention have been described, it is understood that the present invention should not be limited to these preferred embodiments but various changes and modifications can be made by one skilled in the art within the spirit and scope of the present invention as hereinafter claimed.

What is claimed is:

1. A refrigerator having a user avatar display function, the refrigerator comprising:

a photographing device that photographs images of users for storage and an image of a current user currently accessing the refrigerator;

a storage device that stores user information for identifying the users and avatar information including avatars corresponding to the users or the user information;

a display that displays the avatars;

a reading device that reads food information provided on food stored in the refrigerator so as to identify food being taken out of the refrigerator; and a controller that reads and compares the user information with the images of the users photographed by the photographing device to identify the current user, reads the avatar information corresponding to the identified current user, automatically modifies features of the avatar of the identified current user based on the food information to generate a modified avatar for the identified current user, wherein the controller modifies characteristics of the avatar of the identified current user to generate the modified avatar, wherein the modified characteristics provide an indication to the current user of an effect on the current user of the food being taken out of the refrigerator, and displays the modified avatar on the display thereafter.

2. The refrigerator of claim 1, wherein the storage device stores message information including messages to be received by one or more of the users whose user information and avatar information is stored in the storage device.

3. The refrigerator of claim 2, wherein the messages comprise at least one of image messages, sound messages, or text messages.

4. The refrigerator of claim 2, wherein the controller reads the messages corresponding to the avatars of the users from the message information, and displays the messages on the display.

5. The refrigerator of claim 3, further comprising a speaker that provides the sound messages.

6. The refrigerator of claim 1, wherein the images of the users comprise at least one of iris images, fingerprint images, or body shapes of the users.

7. The refrigerator of claim 6, wherein the body shapes comprise at least faces.

8. The refrigerator of claim 3, further comprising an input device that receives at least one of commands or data from the users.

9. The refrigerator of claim 8, wherein the storage device stores avatar formation information that forms the avatars, the input device receives selection of the avatars by the users in the avatar formation information, and the controller adds the selected avatars to the avatar information corresponding to the user information.

10. The refrigerator of claim 8, wherein the input device receives a selection of at least one of the users or at least one of the avatars as a receiver of the messages, and the controller adds information on the at least one of the receivers or the at least one of the avatars to the message information.

11. The refrigerator of claim 8, wherein the input device receives the text messages.

12. The refrigerator of claim 1, wherein the storage device stores nutrition information of a plurality of different foods, and wherein the controller reads the nutrition information, calculates an ingestion quantity of the current user based on the food information included in the user information and the nutrition information stored in the storage device, modifies the avatar of the current user based on the calculated ingestion quantity, and displays the modified avatar on the display.

13. The refrigerator of claim 1, wherein the storage device stores biorhythm information for the users, and the controller modifies the avatar of the current user based on the biorhythm information stored in the storage device for the current user, and displays the modified avatar on the display.

14. A refrigerator having a user avatar display function, the refrigerator comprising:

a storage device that stores avatar information including a plurality of avatars corresponding to a plurality of users;

a display that displays the avatars; and a controller that reads and selectively displays one of the stored plurality of avatars on the display that corresponds to a current user currently accessing the refrigerator, wherein the controller modifies features of the avatar corresponding to the current user based on additional user-related information and displays the modified avatar on the display when the avatar is modified, wherein the controller automatically modifies characteristics of the avatar corresponding to the current user to generate the modified avatar, and wherein the modified characteristics provide an indication to the current user of an effect on the current user of the additional user-related information.

15. The refrigerator of claim 14, wherein the additionally read user-related information comprises food information for foods which the current user has ingested.

16. The refrigerator of claim 15, further comprising a reading device that identifies food information for food taken out of the refrigerator, wherein the additional user-related information includes the food information identified by the reading device for the foods which the users have ingested.

17. The refrigerator of claim 15, wherein the storage device stores nutrition information for a plurality of different foods, and the controller calculates an ingestion quantity of the current user based on the food information and the nutrition information, modifies the avatar of the current user based on the calculated ingestion quantity of the current, and displays the modified avatar on the display.

18. The refrigerator of claim 14, wherein the additional user-related information comprises biorhythm information.

19. A refrigerator having a user avatar display function, the refrigerator comprising:

a photographing device that photographs images of users for storage and an image of a current user currently accessing the refrigerator, wherein the images comprise at least one of iris images, fingerprint images, or body shapes;

a storage device that stores user information for identifying the users based on the images photographed by the photographing device and avatar information having avatars corresponding to at least one of the users or user information;

a display that displays the avatars; and a controller that reads and compares the user information with the images of the users photographed by the photographing device to identify the current user, reads the avatar information corresponding to the identified current user, automatically modifies features of the avatar corresponding to the current user based on additionally read user-related information, wherein the modified features provide an indication to the current user of an effect on the current user of the additionally read user-related information, and displays the modified avatar on the display when the avatar is modified.

* * * * *